US007106660B2

(12) United States Patent
Jenkins

(10) Patent No.: US 7,106,660 B2
(45) Date of Patent: Sep. 12, 2006

(54) SUN DIAL AND METHOD FOR DETERMINING AVERAGE SUNLIGHT

(75) Inventor: Nevin Jenkins, Homosassa, FL (US)

(73) Assignee: New Ventions, Inc., Homosassa, FL (US)

( * ) Notice: Subject to any disclaimer, the term of this patent is extended or adjusted under 35 U.S.C. 154(b) by 279 days.

(21) Appl. No.: 10/666,554

(22) Filed: Sep. 19, 2003

(65) Prior Publication Data

US 2005/0063253 A1 Mar. 24, 2005

(51) Int. Cl.
*G04B 47/06* (2006.01)
*G04C 17/34* (2006.01)
*G04C 21/02* (2006.01)

(52) U.S. Cl. ..... 368/11; 368/10; 33/270

(58) Field of Classification Search ..... 368/16, 368/12, 17, 67, 80, 291, 10, 11; 33/268, 33/269, 270, 271

See application file for complete search history.

(56) References Cited

U.S. PATENT DOCUMENTS 5,107,123 A * 4/1992 Shi ..... 250/372
5,644,358 A * 7/1997 Miyano et al. ..... 348/223.1
6,597,457 B1 * 7/2003 Silverglate et al. ..... 356/446
6,760,099 B1 * 7/2004 Lewis et al. ..... 356/218
2003/0066299 A1 * 4/2003 Aoki ..... 62/186
2005/0230598 A1 * 10/2005 Hopkins et al. ..... 250/208.1

* cited by examiner

*Primary Examiner*—Kamand Cuneo
*Assistant Examiner*—Jeanne-Marguerite Goodwin
(74) *Attorney, Agent, or Firm*—Martin Fleit; Paul D. Bianco; Fleit Kain Gibbons Gutman Bongini & Bianco, P.L.

(57) ABSTRACT

A sun dial including a housing, a light detector mounted on the housing exposed to detect ambient light, a logic circuit mounted in the housing for processing the detected light for determining over a preselected period of time the average light detected by the light detector, and an indicator to indicate upon demand, the average light detected during the preselected period of time. A method for determining average light detected over a period of time by detecting light above a preselected threshold indicative of darkness, while noting the time of darkness, adjusting the period of time by subtracting the time of darkness from the period of time, calculating the average light detected over the adjusted period of time, and giving a visual indication of the average light detected.

3 Claims, 3 Drawing Sheets

SUN DIAL AND METHOD FOR DETERMINING AVERAGE SUNLIGHT

BACKGROUND OF THE INVENTION

1. Field of the Invention

The present invention relates to a sundial and method for determining average sunlight.

2. Prior Art

Heretofore, home gardeners have not had available a sun dial to indicate the current condition of the sunlight streaming into their homes, nor have they had the possibility of determining the average sunlight illuminating a given area of their homes for a period of time to give an indication of what kind of plant would best thrive in that area.

SUMMARY OF THE INVENTION

The foregoing problem is solved by the present invention which provides a sun dial to give an indication of current sunlight and an average light over a period of time. This is accomplished by a sun dial consisting of a cylindrical housing that contains an electronic logic circuit that is driven by a light sensor, such as a photodetector. The circuitry is such that the sun dial is enabled to indicate the current condition of the sunlight for a given area and an average sunlight over a preselected period of time.

DETAILED DESCRIPTION OF PREFERRED EMBODIMENTS OF THE INVENTION

Figure 1:
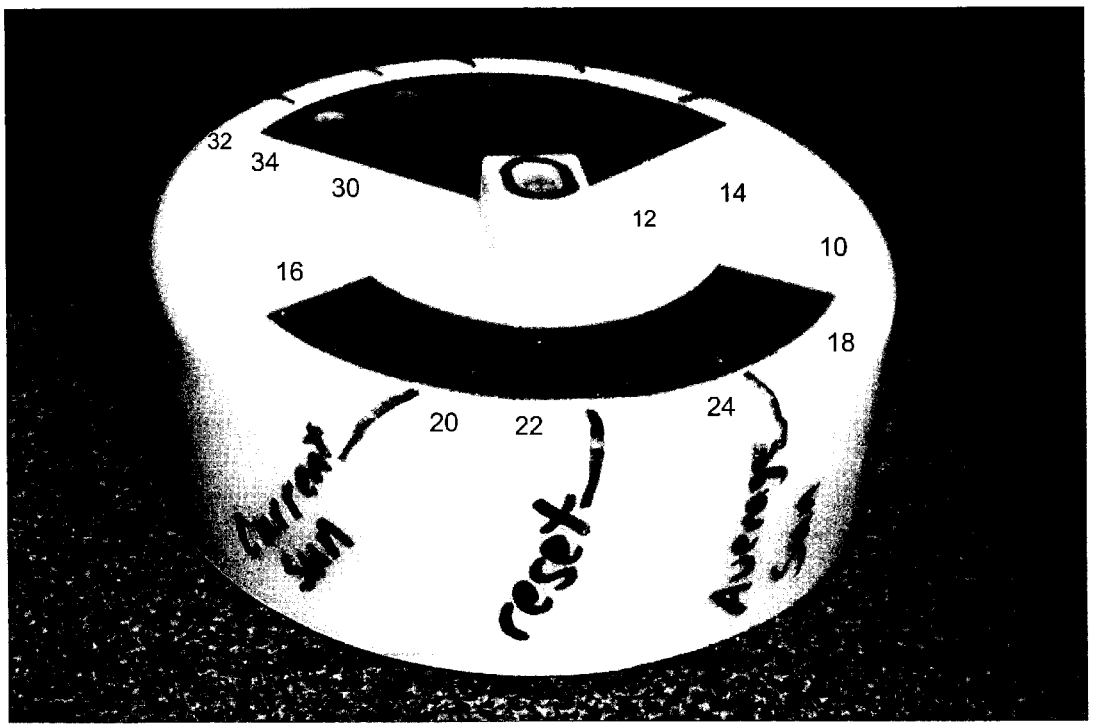
FIG. 1 is a perspective view of the sun dial of the present invention as seen from one side.
Figure 2:
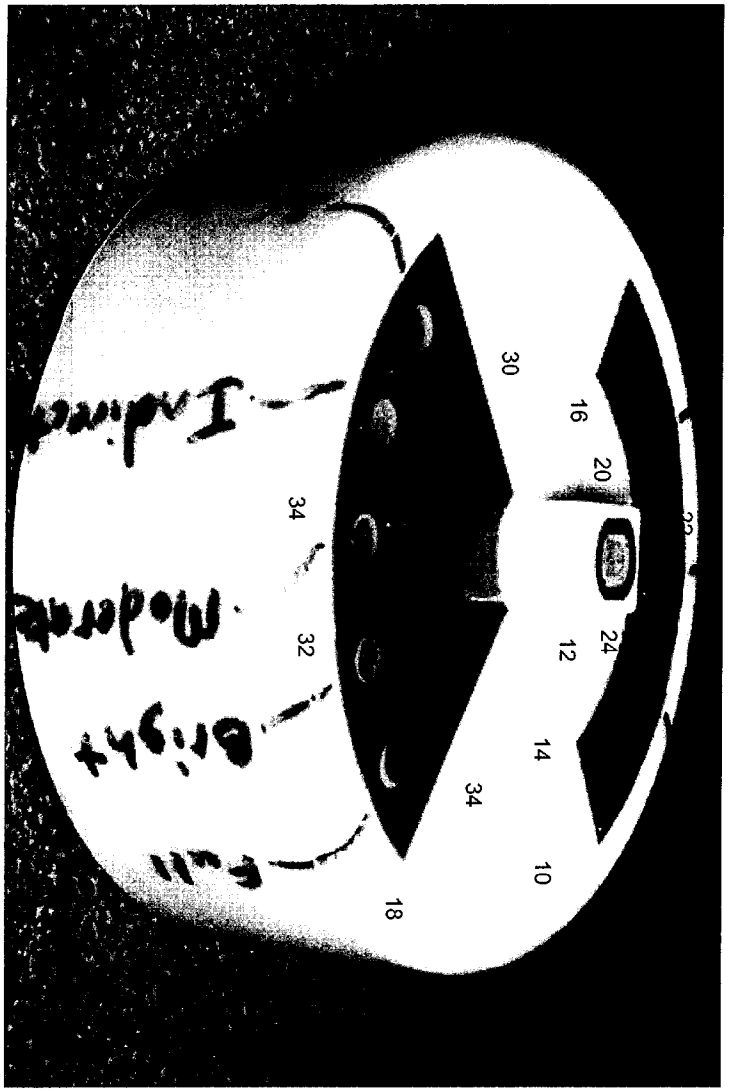
FIG. 2 is a perspective view of the sun dial of FIG. 1 as seen from the opposite side.

Referring now to the drawings, the invention will now be described in detail. As seen in FIGS. 1 and 2 the sun dial consists of a cylindrical housing 10 having an upstanding post 12 at the center of its top surface 14. One side of the top surface 14 is provided with an arcuate band 16 that parallel the outer edge 18 of the top surface 14, for about 60 arc degrees. Located in the band are three tactile switches 20, 22, 24 that are manually actuated by pressing down. As shown in FIG. 1 switch 20 when actuated will show current sun, switch 24 will show average sun, and switch 22 will reset the device. On the opposite side of the top surface 14 is a pie shaped band 30 that correlates with indicia 32 on the top edge 18 that indicates respectively, FULL (SUN), BRIGHT (SUN), MODERATE (SUN), INDIRECT (SUN) and SHADE. In the pie shaped band, adjacent the respective indicia are LEDs 34, which light up according to the condition to be indicated as determined by the logic circuit and program of FIG. 3.

The logic circuit is contained in the cylindrical housing 10 and is controlled by the switches 20 to 24.

Figure 3:
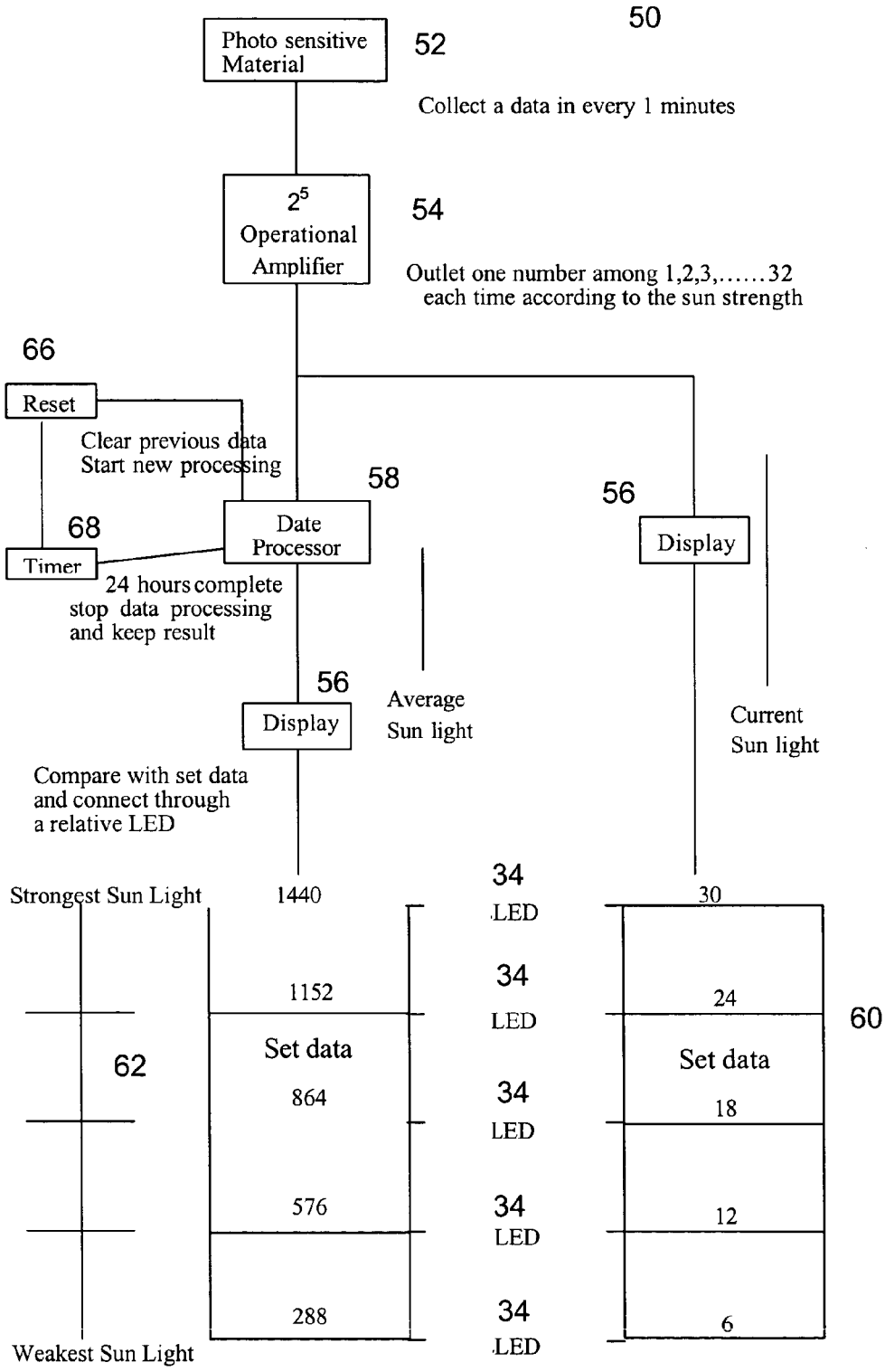
FIG. 3 is a circuit schematic showing the logic diagram of the electronic circuitry of the sun dial and illustrating the method of the invention.

As shown in FIG. 3, the logic circuit 50 consists of a photodetector 52 that is mounted at the top of the post 12 to be exposed to sunlight. The photodetector 52 is arranged to readout every minute, and its readout is fed to $2^5$ operational amplifier 54 that outputs a number from 1, 2, 3 to 32 for each cycle of the photodetector 52. The output from the operational amplifier 54 is available to the display 56 in the event the switch 20 is depressed to give a visual indication of the current sunlight. The displayed data of current sunlight is compared with set data 60 and the appropriate LED 34 is lit.

The output from the operational amplifier is also available to a data processor 58 to calculate average sunlight, which is indicated on display 56 in the event that switch 24 is depressed or actuated. The data of display 56 is compared with set data 62 and the appropriate LED 34 is lit.

As noted, the purpose of the reset button or switch is to reset the program for a new data cycle. Switch 22 is connected to the data processor 58 via the reset block 66 to effect this function. However, the set cycle is 24 hours under the control of timer 68 also connected to the data processor 58 and reset block 66, and the switch 22 is only enabling if depressed after 24 hours from initiation. If depressed before the expiration of 24 hours, the LEDs will flash repeatedly for a preselected time to alert the user that 24 hours has not elapsed, and the program will not stop, but will continue for the full 24 hour cycle.

Another important feature of the system is that the photodetector is provided with a threshold to detect a minimum amount of sunlight. If the amount of light is below the threshold, i.e. darkness, the photodetector will not produce an output, and the time of darkness will be recorded by the data processor and subtracted from the elapsed time for the computation of the average sun light, in order that a realistic measure of the average can be obtained.

Although the invention has been described and shown in terms of a preferred embodiment, nevertheless changes are possible which do not depart from the spirit or scope of the invention as recited in the appended claims. Such changes are deemed to come within the purview of the invention as claimed.

What is claimed is:

1. A sun dial comprising a cylindrical housing having a central upstanding post, a light detector mounted on the top of the upstanding post exposed to detect ambient light, a logic circuit mounted in the housing for processing detected light including a timing circuit for resetting the logic circuit at 24 hour periods, a plurality of tactile switches for controlling the logic circuit mounted in the housing adjacent its top surface arrayed arcuately adjacent the peripheral edge of the top surface of the housing over an arc of about 60 degrees, at least three LEDs controlled by the logic circuit arrayed in an about 60 degree arc on the top surface of the housing adjacent it periphery diametrically opposed to the tactile switches, indicia marked on the top surface of the housing associated with the LEDs to indicate at least three conditions of sunlight, whereby the logic circuit processes the detected light to determine the condition of sunlight and when controlled by a selected tactile switch an associated LED will light to show the current condition of sunlight, and when controlled by another selected tactile switch an associated LED will light to show the average sunlight.

2. A sun dial according to claim 1 where a locking circuit is included in the logic circuit to prevent the logic circuit from resetting before the lapse of the 24 hour period, and if reset is improperly attempted, the logic circuit causes the LEDs to flash as an indication thereof.

3. A sun dial according to claim 1 wherein the logic circuit includes a threshold circuit to determine whether the sunlight detected is above a minimum amount, and to subtract the time when the detected sunlight or absence thereof is below the minimum.

* * * * *